US006660222B1

(12) United States Patent
Heinrich et al.

(10) Patent No.: US 6,660,222 B1
(45) Date of Patent: Dec. 9, 2003

(54) COOLING PLATE FOR A SHAFT FURNACE

(75) Inventors: Peter Heinrich, Geldern (DE); Hartmut Hille, Moers (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/958,384

(22) PCT Filed: Apr. 6, 2000

(86) PCT No.: PCT/EP00/03063

§ 371 (c)(1),
(2), (4) Date: Jan. 3, 2002

(87) PCT Pub. No.: WO00/61821

PCT Pub. Date: Oct. 19, 2000

(30) Foreign Application Priority Data

Apr. 9, 1999 (DE) ..... 199 15 942
Jan. 13, 2000 (DE) ..... 100 00 987

(51) Int. Cl.[7] ..... C21B 7/10
(52) U.S. Cl. ..... 266/193; 266/194
(58) Field of Search ..... 266/193, 194; 122/6 A, 6 B, 6 C

(56) References Cited

U.S. PATENT DOCUMENTS 4,121,809 A * 10/1978 Dhelft ..... 266/193
4,342,118 A 7/1982 Tinchant
4,938,456 A * 7/1990 Richards ..... 266/194
5,426,664 A 6/1995 Grove
6,132,673 A * 10/2000 Hille et al. ..... 266/193
6,257,326 B1 * 7/2001 Heinrich ..... 165/169

FOREIGN PATENT DOCUMENTS

| | | |
|---|---|---|
| DE | 4035893 | 1/1992 |
| GB | 1349619 | 4/1974 |
| GB | 2137326 | 10/1984 |

* cited by examiner

*Primary Examiner*—Scott Kastler
(74) *Attorney, Agent, or Firm*—Friedrich Kueffner

(57) ABSTRACT

A cooling plate for shaft furnaces, in particular, for blast furnaces, provided with a refractory lining, comprising cooling channels loadable with a cooling medium, wherein at least the front side facing the interior of the furnace is comprised of an ingot, produced preferably of copper or a low-alloy copper alloy and provided with grooves for receiving refractory material, is to be further developed such that it can be produced with a minimal material expenditure and a minimal manufacturing expenditure and can be easily mounted, and that with it a higher cooling capacity with reduced cooling medium throughput can be realized, wherein the own heat uptake is limited such that a significantly longer service life can be obtained. For this purpose it is suggested that two through-shaped rolled sections with their domed areas facing outwardly, respectively, are welded together and that bores for receiving the ends of pipe connector pieces are introduced into the backside supplemental section and the ends welded thereto, and that the free ends of the rolled sections are closed off by caps.

3 Claims, 3 Drawing Sheets

COOLING PLATE FOR A SHAFT FURNACE

BACKGROUND OF THE INVENTION

1. Field of the Invention

The invention relates to cooling plates (so-called staves) for shaft furnaces, in particular, blast furnaces, provided with a refractory lining, comprising cooling channels loadable with a cooling medium, wherein at least the front side facing the interior of the furnace is comprised of an ingot, produced preferably of copper or a low-alloy copper alloy and provided with grooves for receiving refractory material.

2. Description of the Related Art

It is known to provide such cooling plates with a water cooling system and to produce them of copper or a low-alloy copper alloy in order to provide a minimal resistance to the heat to be dissipated.

In the prior German patent 29 07 511 the cooling channels are provided in a forged or rolled ingot as vertically extending blind bores which are introduced by mechanical gun drilling. Such cooling plates must have a relatively great thickness in order for the cooling channels to have still a sufficient wall thickness to withstand the operating pressure of the cooling medium. Copper plates of the thickness required for this are expensive as a result of the high copper prices. The blind bores have for a circular cross-section only the smallest possible inner surface area. Accordingly, for heat exchange with the cooling medium only little surface area is available, and only a moderate heat dissipation is achieved. This results in high thermal stress of the cooling plate, and this negatively affects its service life.

SUMMARY OF THE INVENTION

The invention has the object to configure cooling plates of the aforementioned kind such that they can be produced with a reduced material expenditure and a reduced manufacturing expenditure and can be mounted more easily in comparison to those known in the art and that with them higher cooling capacities with reduced cooling medium throughput can be realized wherein the own heat uptake is limited such that a significantly longer service life can be obtained.

As a solution to this object it is provided to produce the front part of the cooling plate trough-shaped in the central area as a domed rolled part of relatively minimal thickness so that a considerable amount of copper material can be saved and to supplement the domed area by a second, also outwardly domed rolled part to a cooling channel with a cross-section deviating from a circular shape and to thus provide a higher cooling output. In addition to the advantage of a reduced copper consumption, this provides the benefit of a more intensive cooling action which, as desired, increases the service life.

Advantageous and expedient further developments of the subject matter of the invention are characterized in the dependant claims.

BRIEF DESCRIPTION OF THE DRAWINGS

The invention will be explained with the aid of the description of one embodiment in connection with the drawings illustrating it. It is shown in:

In FIG. 1 a cross-section of the cooling plate, positioned at the center of its length, is illustrated which shows a shield 1 which faces the interior of the furnace and is rolled of copper or a copper alloy to be through-shaped. Transversely extending grooves 4 have been rolled into its free surface which, at the end of the assembly, facilitate the application of refractory ramming or spraying material which are beneficial for the later adhesion of the burden. In order to provide an efficient cooling channel 2, a supplemental section 3 is connected by welding seams 13 to the shield 1. This supplemental section is also rolled to be trough-shaped; however, across substantial portions of its length it also has a stay 5, which extends perpendicularly from its center which and increases, on the one hand, the stability of the entire cooling plate and, on the other hand, facilitates its assembly.

DETAILED DESCRIPTION OF THE PREFERRED EMBODIMENTS

Figure 1:
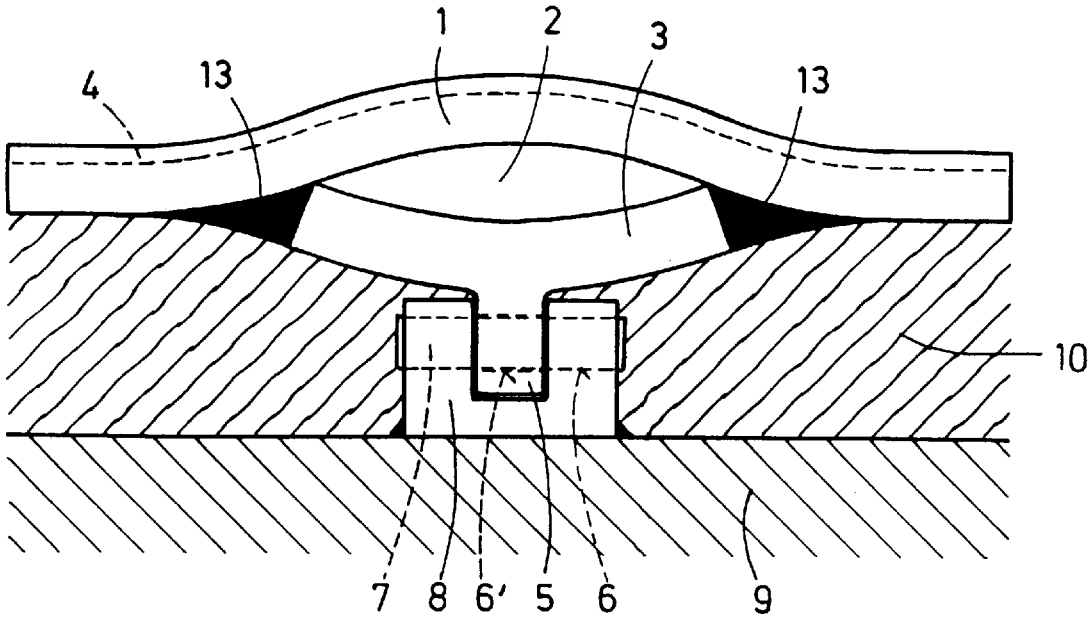
FIG. 1 a central cross-section of the cooling plate.

For assembly, a holder 8 is fastened to the inner wall 9 of the shaft furnace, in the embodiment by welding, which holder is provided with bores 6. For effecting the assembly, it is sufficient to introduce the stay 5 into the holder 8 and to introduce a bore 6' into the stay 5 from the side which bore is aligned with the bore 6 in the holder 8. The actual connection is then realized by inserting and securing the bolt 7 in the bores 6, 6'. Subsequently, the cooling plate can be back-filled with a back-filling material 10 and subsequently, not illustrated in FIG. 1, the surface of the shield 1 of the cooling plate can be covered with a refractory ramming or spraying material.

Figure 2:
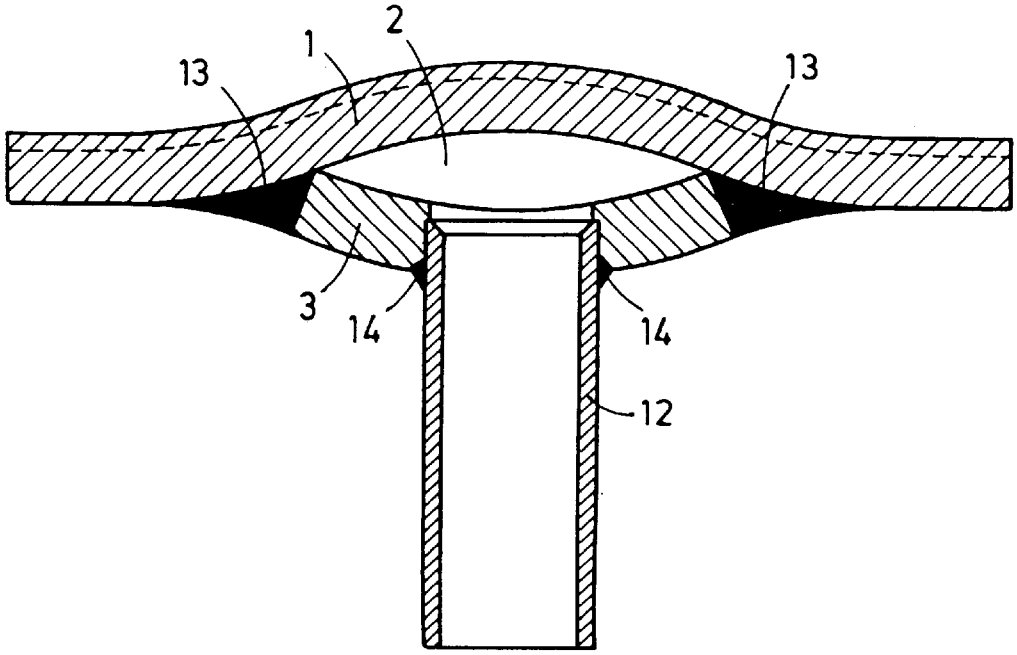
FIG. 2 a cross-section of the cooling plate extending through the area of the pipe connecting pieces.
Figure 3:
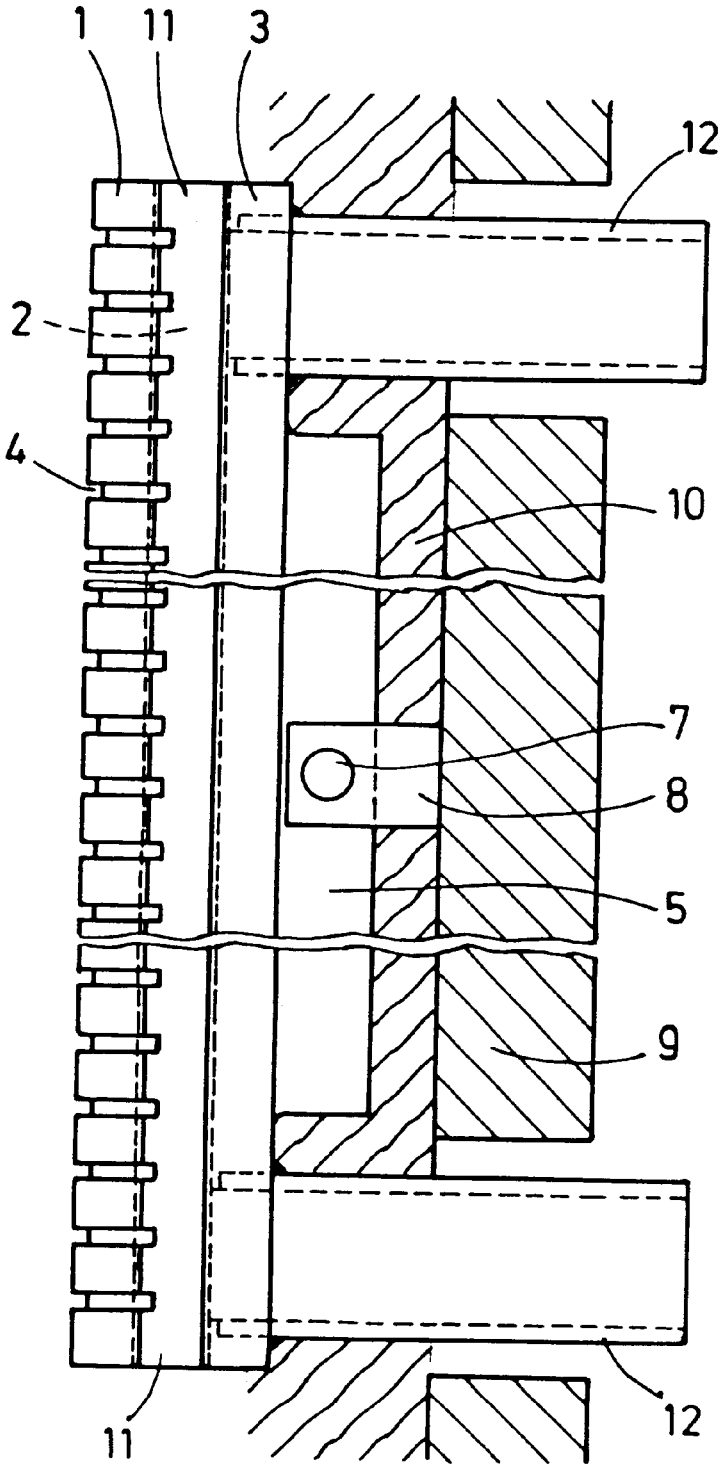
FIG. 3 a twice interrupted longitudinal section of a cooling plate mounted on a shaft furnace wall.
Figure 4:
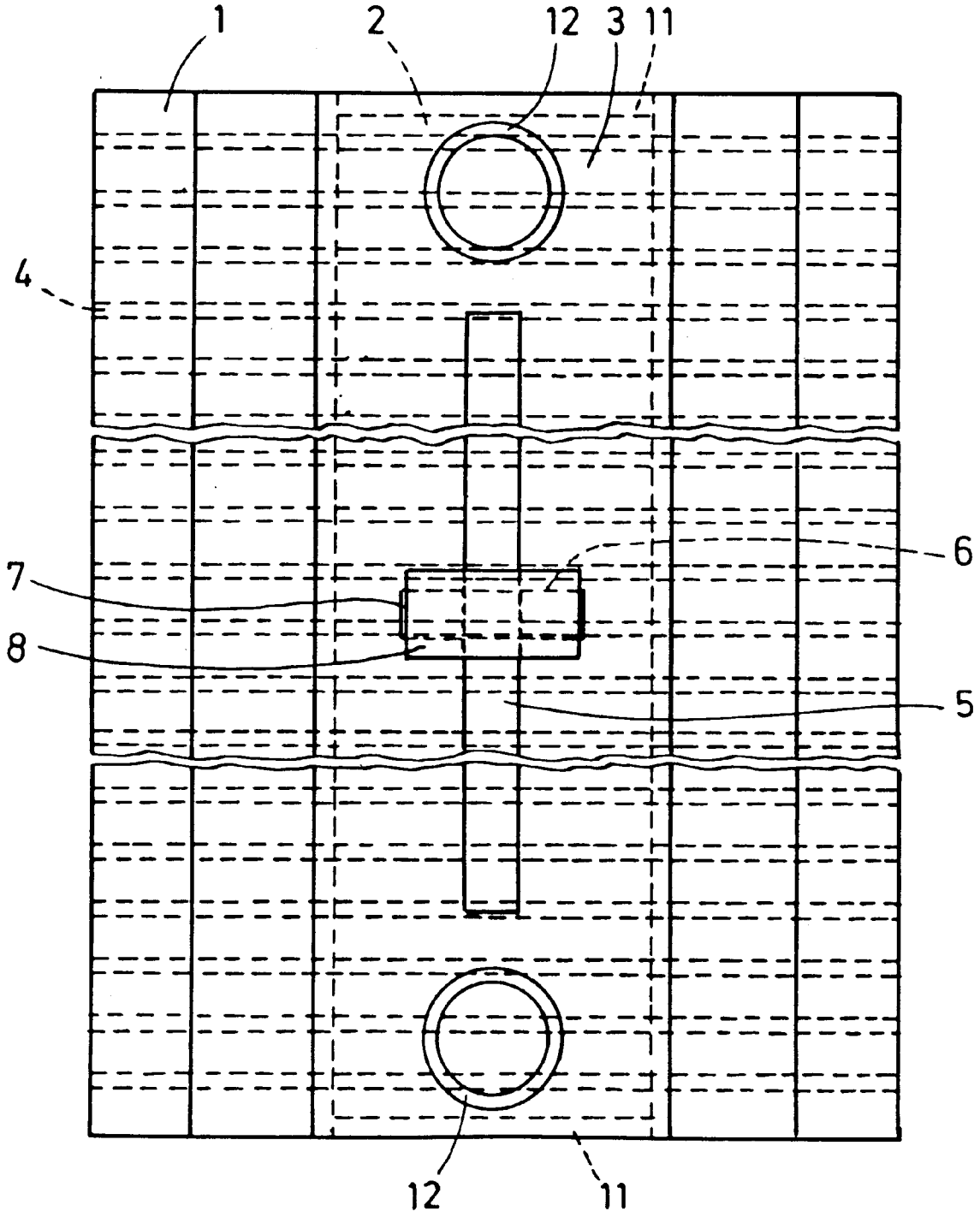
FIG. 4 a view of the cooling plate from the rear.

FIG. 2 shows also a cross-section of a cooling plate but in its end area. The shield 1 as well as the supplemental section 3 are illustrated which are fixedly and tightly connected by welding seams 13. Into a bore provided in the supplemental section 3 one end of a pipe connector piece 12 is inserted and connected with the supplemental section fixedly and tightly by a welding seam 14. A corresponding longitudinal section which shows, in particular, both ends with caps 11 and pipe connector pieces 12 is shown in FIG. 3.

In practice, the cooling plate is not used individually; it is provided as a module which is combined to larger cooling surfaces. Mounting of the cooling elements is carried out such that the front parts of the cooling plate, positioned laterally to the cooling channel and representing only one element of the cooling surface, overlap with corresponding parts of the neighboring cooling plate. In this way, in conical sections of a blast furnace armor, for example, the belly of the shaft furnace, the shaft or the like, it is possible to provide a compensation of different diameters or peripheries of the armor without the width dimensions of the cooling plate having to be adjusted to the cone shape.

The welding of the shield 1 with the supplemental section 3 to form the cooling plate or the modular cooling element is carried out preferably continuously by means of a corresponding welding robot so that a uniform, flawless, and liquid-tight configuration of the welding seam is ensured. While for reasons of thermal conduction the shield 1 is manufactured of copper or a copper-rich alloy, the supplemental section 3 can be produced of less expensive materials which possibly have the advantage of higher strength. It is only important that the shield 1 and the supplemental section 3 can be welded well and easily.

List of Reference Numerals

1 shield
2 cooling channel
3 supplemental section
4 groove

5 stay
6 bore
7 bolt
8 holder
9 inner wall
10 back-filling material
11 cap
12 pipe connector piece
13 welding seam
14 welding seam

What is claimed is:

1. In a cooling plate for a shaft furnace provided with a refractory lining, the cooling plate including first and second rolled sections of copper or a low-alloy copper alloy, wherein the first and second rolled sections are welded together so as to form a cooling channel therebetween, wherein the cooling channel is closed at ends of the rolled sections by caps, and wherein at least the first rolled section facing an interior of the furnace has grooves for receiving and supporting refractory material, the improvement comprising the first and second rolled sections each having a single trough, wherein the troughs of the two rolled sections form the cooling channel extending in a single direction, wherein the second rolled section facing away from the furnace interior is narrower than the first rolled section, wherein the second rolled section is arranged between essentially straight border areas of the first rolled section, and wherein the second rolled section has bores with pipe connector pieces welded into the bores.

2. The cooling plate according to claim 1, wherein the second rolled section comprises a stay projecting away from the first rolled section.

3. The cooling plate according to claim 2, wherein an inner wall of the shaft furnace is connected to holders enclosing the stay, and wherein the holders and the stay have bores aligned with one another and penetrated by bolts.

* * * * *